US010879675B2

(12) United States Patent
Yoshida et al.

(10) Patent No.: US 10,879,675 B2
(45) Date of Patent: Dec. 29, 2020

(54) SPARK PLUG

(71) Applicant: NGK SPARK PLUG CO., LTD., Nagoya (JP)

(72) Inventors: Haruki Yoshida, Tajimi (JP); Kuniharu Tanaka, Komaki (JP); Yutaka Yokoyama, Kasugai (JP); Shun Kondo, Obu (JP); Hirokazu Kurono, Nagoya (JP); Toshimasa Saji, Kounan (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 253 days.

(21) Appl. No.: 15/607,714

(22) Filed: May 30, 2017

(65) Prior Publication Data

US 2017/0353013 A1 Dec. 7, 2017

(30) Foreign Application Priority Data

Jun. 1, 2016 (JP) ..... 2016-109858

(51) Int. Cl.
*H01T 13/20* (2006.01)
*H01T 13/38* (2006.01)
(Continued)

(52) U.S. Cl.
CPC ..... *H01T 13/20* (2013.01); *H01T 13/38* (2013.01); *H01T 13/06* (2013.01); *H01T 13/39* (2013.01); *H01T 21/02* (2013.01)

(58) Field of Classification Search
CPC ..... H01T 13/20; H01T 13/06; H01T 13/38; H01T 21/02
(Continued)

(56) References Cited

U.S. PATENT DOCUMENTS 4,491,101 A * 1/1985 Strumbos ..... H01T 13/16 123/169 C
4,724,182 A * 2/1988 Kato ..... H01L 23/15 219/543
(Continued)

FOREIGN PATENT DOCUMENTS

JP 10-308272 11/1998
JP 2001-143847 A 5/2001 ..... H01T 13/20
(Continued)

OTHER PUBLICATIONS

Office Action received in corresponding Japanese Patent Application No. 2016-109858, dated Jul. 24, 2018.

*Primary Examiner* — Mahmoud Gimie
*Assistant Examiner* — Joshua Campbell
(74) *Attorney, Agent, or Firm* — Kusner & Jaffe

(57) ABSTRACT

A spark plug having an insulator with a leg portion whose outer circumferential surface has an arithmetic mean roughness Ra of 0.5 μm or less. The leg portion has a first section, a second section, and a third section. The first section has an outer diameter that decreases toward the forward end of the first section. The second section is located forward of and adjacent to the first section and its outer diameter decreases toward the forward end of the second section. The outer circumferential surface of the second section is located inward of a first straight line passing through the base and forward ends of the outer circumferential surface of the first section. The third section is located forward of and adjacent to the second section. The outer diameter of the third section is equal to or less than a forward end outer diameter Ds of the second section over the entire third section.

11 Claims, 4 Drawing Sheets

(51) Int. Cl.
*H01T 21/02* (2006.01)
*H01T 13/06* (2006.01)
*H01T 13/39* (2006.01)

(58) Field of Classification Search
USPC ..... 123/169 R, 169 CA; 313/143; 445/7
See application file for complete search history.

(56) References Cited

U.S. PATENT DOCUMENTS

| | | | | |
|---|---|---|---|---|
| 6,208,066 | B1 * | 3/2001 | Kokubu | H01T 13/52 313/141 |
| 6,628,050 | B1 * | 9/2003 | Kameda | H01T 13/20 313/141 |
| 2003/0127959 | A1 * | 7/2003 | Nishikawa | C03C 3/066 313/143 |
| 2007/0188063 | A1 * | 8/2007 | Lykowski | H01T 13/38 313/137 |
| 2010/0201245 | A1 * | 8/2010 | Miller | H01T 13/20 313/143 |
| 2011/0266940 | A1 | 11/2011 | Suzuki et al. | |

FOREIGN PATENT DOCUMENTS

| | | | | |
|---|---|---|---|---|
| JP | 2014-107084 | A | 6/2014 | H01T 13/20 |
| WO | WO 2010/082409 | A1 | 7/2010 | |

* cited by examiner

SPARK PLUG

RELATED APPLICATIONS

This application claims the benefit of Japanese Patent Application No. 2016-109858, filed Jun. 1, 2016, the entire contents of which is incorporated herein by reference.

FIELD OF THE INVENTION

The present invention relates to a spark plug. More particularly, the present invention relates to a spark plug in which the occurrence of rearward sparking is prevented while the strength of an insulator is ensured.

BACKGROUND OF THE INVENTION

A spark plug used for ignition of an internal combustion engine such as an automobile engine generally includes: a tubular metallic shell; a tubular insulator disposed in a bore of the metallic shell; a center electrode disposed in a bore of the insulator at the forward end of the bore; and a ground electrode with one end joined to the forward end of the metallic shell and the other end forming a spark discharge gap in cooperation with the center electrode. With this spark plug, spark discharge occurs in the spark discharge gap formed between the forward end of the center electrode and the distal end of the ground electrode within a combustion chamber of an internal combustion engine to thereby ignite fuel supplied to the combustion chamber.

Due to recent demands for increasing engine output power, decreasing fuel consumption, etc., the compression ratio of engines tends to increase, and the discharge voltage of spark plugs tends to increase. This occasionally causes a phenomenon called flashover in which discharge occurs in a region other than the normal spark discharge gap, such as a gap between the insulator and the metallic shell. When flashover occurs, the frequency of occurrence of discharge in the normal spark discharge gap decreases, and the ability to ignite an air-fuel mixture decreases. There are two types of flashover; i.e., lateral sparking which is caused by dielectric breakdown and in which spark propagates from the forward end of the insulator laterally toward the metallic shell, and rearward sparking in which spark propagates from the forward end of the insulator toward the base end of the metallic shell along the outer surface of the insulator. The possibility of occurrence of flashover, particularly the rearward sparking, increases as the degree of irregularities on the outer surface of the insulator decreases.

As the engine compression ratio increases, an impact applied to the insulator because of vibration etc. caused by pressure changes in the combustion chamber tends to increase. Meanwhile, reduced wall thickness of the insulator has been demanded so as to meet a demand for reduction in spark plug diameter. Namely, the present situation is such that although the impact applied to the insulator tends to cause stress concentration on the insulator, it is difficult to employ a method of increasing the wall thickness of the insulator so as to make the insulator sufficiently strong to endure stress.

With recent improvements in performance of engines, there is a need for spark plugs in which the occurrence of flashover is prevented while the strength of their insulators is ensured.

For example, in Japanese Patent Application Laid-Open (kokai) No. 2014-107084, it is stated that "the outer surface of a portion of the insulator which is located forward of its portion in contact with the packing has an arithmetic mean roughness $Ra_1$ of 3 μm to 15 μm inclusive . . . . Since the arithmetic mean roughness $Ra_1$ is 3 μm or more, irregularities on the surface of the insulator prevent flashover . . . . Since the arithmetic mean roughness $Ra_1$ is 15 μm or less, stress acting on the concave portions of the irregularities formed on the surface of the insulator can be reduced. This can prevent damage to the insulator such as breaking or cracking of the insulator, so that the durability of the spark plug can be improved" (paragraph 0007 of Japanese Patent Application Laid-Open (kokai) No. 2014-107084).

FIG. 2 in Japanese Patent Application Laid-Open (kokai) No. 2001-143847 shows an insulator having a step portion on its outer circumferential surface. It is stated that since the step portion is provided, "the intensity of electric field at the step portion is high, and lateral sparking is more likely to occur at the step portion than at other portions. Therefore, the occurrence of sparking on the base end side of the metallic shell 5 is reduced, which allows ignition to occur on the forward end side of the metallic shell 5. Moreover, the self-cleaning effect due to sparking is further enhanced, and carbon fouling is less likely to occur" (paragraph 0026 in Japanese Patent Application Laid-Open (kokai) No. 2001-143847).

In the invention described in Japanese Patent Application Laid-Open (kokai) No. 2014-107084, since the outer surface of the insulator provided has an arithmetic mean roughness $Ra_1$ of 3 μm to 15 μm inclusive, the occurrence of flashover can be prevented while the durability of the insulator is maintained. However, Japanese Patent Application Laid-Open (kokai) No. 2014-107084 does not disclose an insulator whose outer circumferential surface has an arithmetic mean roughness $Ra_1$ of 0.5 μm or less and which has a step portion on the outer surface.

In the invention described in Japanese Patent Application Laid-Open (kokai) No. 2001-143847, since the insulator has a step portion on its outer circumferential surface, carbon fouling is unlikely to occur. However, Japanese Patent Application Laid-Open (kokai) No. 2001-143847 does not disclose the size of the step portion and the arithmetic mean roughness Ra of the outer surface of the insulator.

An advantage of the present invention is to provide a spark plug in which the occurrence of flashover, particularly rearward sparking, is prevented while the strength of the insulator is ensured.

SUMMARY OF THE INVENTION (1) In accordance with a first aspect of the present invention, there is provided a spark plug comprising:

a tubular insulator having an axial hole extending in the direction of an axial line, the insulator including a step portion which is disposed on an outer circumference of the insulator and whose outer diameter decreases toward a forward end of the insulator;

a center electrode disposed at a forward end of the axial hole; and a tubular metallic shell disposed around the insulator, the step portion being engaged with an inner circumference of the metallic shell, wherein the insulator includes a leg portion located forward of and adjacent to the step portion, and an outer circumferential surface of the leg portion has an arithmetic mean roughness Ra of 0.5 μm or less, wherein the leg portion includes a first section which is located forward of and adjacent to the step portion and whose outer diameter decreases from a base end of the first section toward a forward end thereof, a second section which is located forward of and adjacent to the first section and whose outer diameter decreases from a base end of the second section toward a forward end thereof, wherein, in a cross section obtained by cutting the leg portion and including the axial line, a line representing an outer circumferential surface of the second section is located inward of a first straight line passing through base and forward ends of an outer circumferential surface of the first section, and a forward end angle θ between the first straight line and a second straight line passing through base and forward ends of an outer circumferential surface of the second section is θ≥15°, and a third section which is located forward of and adjacent to the second section and whose outer diameter is equal to or less than a forward end outer diameter Ds of the second section over the entire third section, wherein, in the cross section, a line representing at least an outer circumferential surface of a rear end portion of the third section, which rear end portion is connected to the forward end of the second section, is located outward of the second straight line, and wherein an expression (Dk−Ds)/2 which represents the relation between the forward end outer diameter Ds and a base end outer diameter Dk of the second section satisfies 5 μm≤(Dk−Ds)/2≤200 μm.

(2) In accordance with a second aspect of the present invention, there is provided a spark plug as described above, wherein the center electrode includes, at a rear end thereof, a projecting portion protruding radially outward, wherein the axial hole of the insulator has an inner step portion engaged with the projecting portion of the center electrode, wherein a portion of an inner circumferential surface of the axial hole, which portion faces the center electrode, has an arithmetic mean roughness Ra of 0.5 μm or less, and wherein, in a cross section obtained by cutting the insulator and including the axial line, when a line segment representing a portion of the axial hole, which portion is located forward of and adjacent to the inner step portion and extends linearly from a base end of that portion to a forward end thereof is defined as a line segment $T_1$, and a line segment representing a forward end surface of the insulator is defined as a line segment $T_2$, and an intersection between a virtual line $L_1$ obtained by extending the line segment $T_1$ forward and a virtual line $L_2$ obtained by extending the line segment $T_2$ radially inward is defined as an intersection a, a distance $d_1$ from the forward end of the line segment $T_1$ to the intersection a and a distance $d_2$ from an axial line-side end of the line segment $T_2$ to the intersection a are 200 μm or less.

(3) In accordance with a third aspect of the present invention, there is provided a spark plug as described above, wherein the arithmetic mean roughness Ra of the outer circumferential surface of the leg portion is 0.1 μm or less.

(4) In accordance with a fourth aspect of the present invention, there is provided a spark plug as described above, wherein the base end of the second section is located at least 3 mm forward of a forward end of a part of the step portion, which part is engaged with the metallic shell.

(5) In accordance with a fifth aspect of the present invention, there is provided a spark plug as described above, wherein an expression (Dk−Ds)/2 which represents the relation between the forward end outer diameter Ds and the base end outer diameter Dk of the second section satisfies 5 μm≤(Dk−Ds)/2≤50 μm.

In the insulator in the present invention, since the arithmetic mean roughness Ra of the outer circumferential surface of the leg portion is 0.5 μm or less, stress concentration on the outer circumferential surface of the leg portion can be prevented, and the desired strength can be ensured. The leg portion in the present invention has the first section, the second section, and the third section, and an expression (Dk−Ds)/2 which represents the relation between the forward end outer diameter Ds of the second section and its base end outer diameter Dk satisfies 5 μm≤(Dk−Ds)/2≤200 μm, so that rearward sparking can be prevented. According to the present invention, a spark plug which has rearward sparking resistance and whose insulator has desired strength can be provided.

DETAILED DESCRIPTION OF THE PREFERRED EMBODIMENTS

First Embodiment

Figure 1:
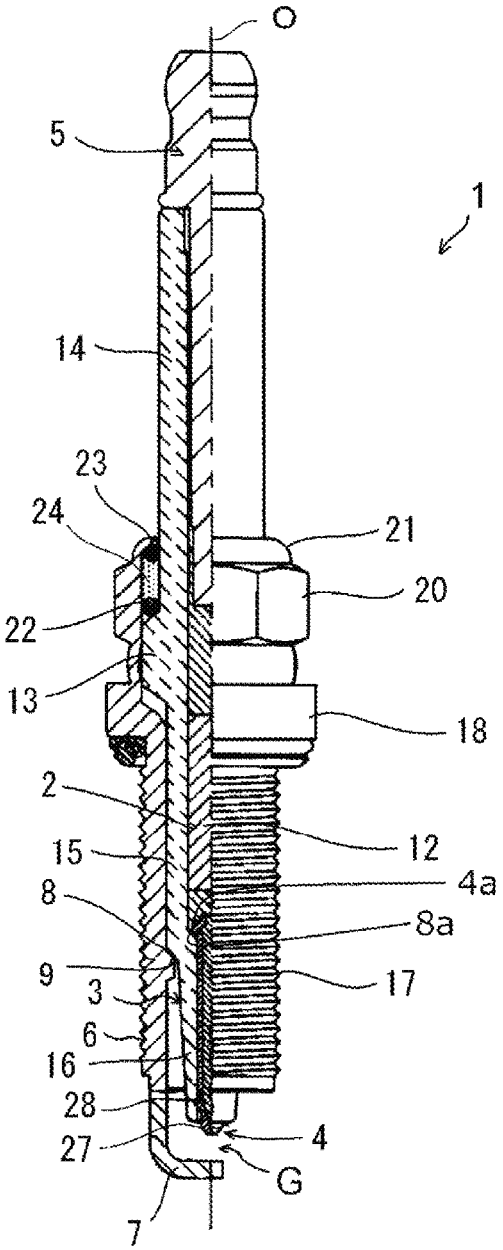
FIG. 1 is a partially sectioned view illustrating the entirety of a spark plug which is an embodiment of the spark plug of the present invention.

FIG. 1 is a partially sectioned view illustrating the entirety of a spark plug 1 which is an embodiment of the spark plug of the present invention. In FIG. 1, a direction toward the lower side of the drawing sheet; i.e., the side on which a ground electrode 7 described later is disposed, is referred to as the forward direction of an axial line O, and a direction toward the upper side of the drawing sheet; i.e., the side on which a metallic terminal 5 is disposed, is referred to as the rearward direction of the axial line O.

As shown in FIG. 1, the spark plug 1 includes a generally tubular insulator 3 having an axial hole 2 extending in the direction of the axial line O, a generally rod-shaped center electrode 4 disposed at the forward end of the axial hole 2, the metallic terminal 5 disposed at the rear end of the axial hole 2, a connecting portion 12 disposed between the center electrode 4 and the metallic terminal 5 within the axial hole 2, a generally tubular metallic shell 6 disposed around the insulator 3, and the ground electrode 7 including a base end portion fixed to the forward end of the metallic shell 6 and a distal end portion disposed so as to face the center electrode 4 with a gap G therebetween.

The insulator 3 is a tubular body including a rear trunk portion 14, a flange portion 13, a forward trunk portion 15, a step portion 8, and a leg portion 16. The center electrode 4 is inserted into the inner space of the tubular body, and an inner step portion 8*a* for engagement with the center electrode 4 is provided on the inner surface of the tubular body. The rear trunk portion 14 contains the metallic terminal 5 and insulates the metallic terminal 5 and the metallic shell 6 from each other. The flange portion 13 is located in an approximately central portion of the insulator 3 and protrudes radially outward. The forward trunk portion 15 is located forward of the flange portion 13, has a smaller outer diameter than the flange portion 13, and contains the connecting portion 12. The step portion 8 is located forward of and adjacent to the forward trunk portion 15. The step portion 8 has a smaller outer diameter than the forward trunk portion 15 and is configured such that the rate of reduction in diameter of the step portion 8 toward the forward end side is larger than those of the forward trunk portion 15 and the leg portion 16. The step portion 8 is in contact with a seat portion 9 described later. The leg portion 16 is located forward of the step portion 8, has a smaller outer diameter than the step portion 8, and contains the center electrode 4. The insulator 3 is fixed to the metallic shell 6 with the forward end portion of the insulator 3 protruding from the forward end of the metallic shell 6. The inner step portion 8*a* is formed on the inner circumferential surface of the insulator 3 at a position approximately corresponding to the step portion 8 formed on the outer surface of the insulator 3. The inner step portion 8*a* is tapered such that a large-diameter inner surface and a small-diameter inner surface of the insulator 3 are connected through the inner step portion 8*a*. Preferably, the insulator 3 is formed from a material with mechanical strength, thermal strength, and electrical strength. One example of such a material is a ceramic sintered body formed mainly of alumina. The details of the insulator 3, which is one feature of the present invention, will be described later.

The connecting portion 12 is disposed between the center electrode 4 and the metallic terminal 5 within the axial hole 2, fixes the center electrode 4 and the metallic terminal 5 within the axial hole 2, and electrically connects the center electrode 4 to the metallic terminal 5.

The metallic shell 6 has a generally tubular shape and is formed such that the insulator 3 inserted into the metallic shell 6 is held by the metallic shell 6. A threaded portion 17 is provided on the outer circumferential surface of a forward end portion of the metallic shell 6. The spark plug 1 is mounted to a cylinder head of an unillustrated internal combustion engine by using the threaded portion 17. The metallic shell 6 has a flange-shaped gas seal portion 18 located rearward of the threaded portion 17, a tool engagement portion 20 formed rearward of the gas seal portion 18 and used for engagement with a tool such as a spanner or a wrench, and a crimp portion 21 located rearward of the tool engagement portion 20. Annular ring members 22 and 23 and talc 24 are disposed in an annular space formed between the outer circumferential surface of the insulator 3 and the inner circumferential surfaces of the crimp portion 21 and the tool engagement portion 20, and the insulator 3 is thereby fixed to the metallic shell 6. The metallic shell 6 has the annular seat portion 9 located forward of the gas seal portion 18 and protruding radially inward from the inner circumference of the metallic shell 6. The seat portion 9 is engaged with the step portion 8, and the insulator 3 is thereby fixed to the metallic shell 6. An annular packing (not shown) may be disposed between the seat portion 9 and the step portion 8 such that the insulator is engaged with the metallic shell through the packing. The inner circumferential surface of the metallic shell 6 which is located forward of the seat portion 9 is formed such that a space is formed between the inner circumferential surface and the leg portion 16 and that the inner circumferential surface is spaced apart from the outer circumferential surface of the leg portion 16. The metallic shell 6 may be formed of an electrically conductive steel material, e.g., low-carbon steel.

The metallic terminal 5 is used to externally apply, to the center electrode 4, a voltage for generating spark discharge between the center electrode 4 and the ground electrode 7. The metallic terminal 5 is inserted into the axial hole 2 with part of the metallic terminal 5 exposed from the rear end of the insulator 3 and is fixed through the connecting portion 12. The metallic terminal 5 may be formed from a metallic material such as low-carbon steel.

The center electrode 4 is fixed within the axial hole 2 of the insulator 3 with the forward end of the center electrode 4 protruding from the forward end of the insulator 3 and is insulated from the metallic shell 6. Specifically, the center electrode 4 has, at its rear end, a projecting portion 4*a* protruding radially outward. The projecting portion 4*a* is formed so as to protrude annularly outward from the outer surface of the center electrode 4 and has an engagement surface (e.g., a taper surface) which is engaged with the inner step portion 8*a* of the leg portion 16. The center electrode 4 in the present embodiment includes an outer layer 27 made of, for example, an Ni alloy, and a core portion 28 made of a material having higher thermal conductivity than the Ni alloy and formed so as to be embedded coaxially in an axially extending central space inside the outer layer 27. Examples of the material forming the core portion 28 include Cu, Cu alloys, Ag, Ag alloys, and pure Ni. The center electrode 4 in the present embodiment has the core portion 28. However, the center electrode 4 may be formed of a single material with no core portion.

The ground electrode 7 has, for example, a generally prismatic shape. The ground electrode 7 is joined at its base end portion to the forward end of the metallic shell 6 and bent at an intermediate portion into a generally L-shape, and the distal end portion of the ground electrode 7 is disposed so as to face the center electrode 4 with the gap G therebetween. The gap G in the present embodiment is the minimum distance between the forward end of the center electrode 4 and a side surface of the distal end portion of the ground electrode 7. The gap G is generally set to 0.3 to 1.5 mm. The ground electrode 7 may be formed from any well-known material, such as an Ni alloy, used for ground electrodes. Like the center electrode 4, the ground electrode 7 may include an outer layer 27 made of, for example, an Ni alloy, and a core portion 28 made of a material having higher thermal conductivity than the Ni alloy, and formed so as to be embedded coaxially in an axially extending central space inside the outer layer 27.

The insulator, which is the feature of the present invention, will next be described.

Figure 2:
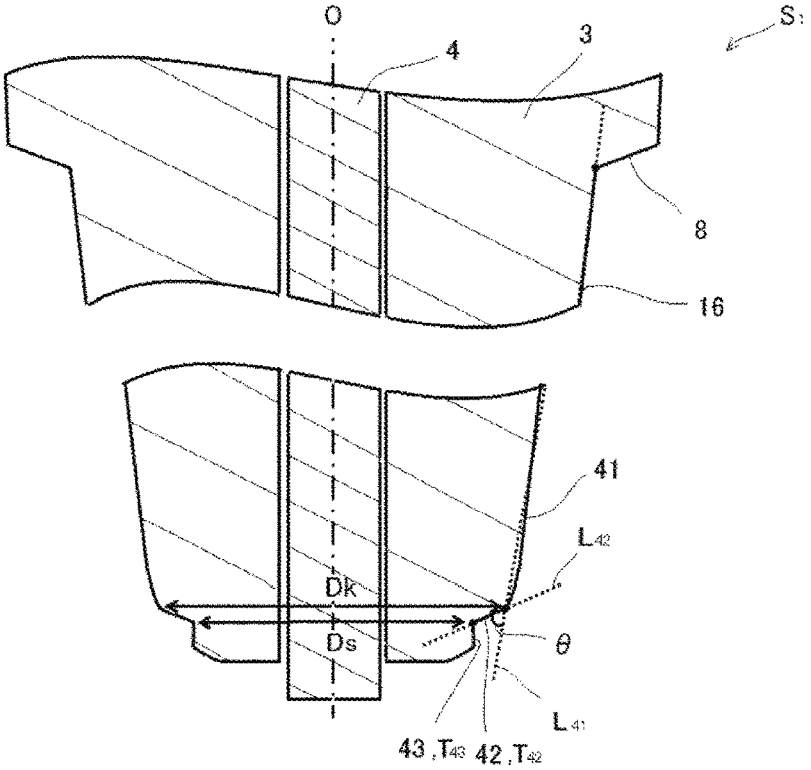
FIG. 2 is a partial cross sectional view showing a cross section which is obtained by cutting an insulator of the spark plug shown in FIG. 1 and includes an axial line.

As shown in FIGS. 1 and 2, at least part of the surface of the insulator 3; i.e., at least the outer circumferential surface of the leg portion 16 of the insulator 3, has an arithmetic mean roughness Ra of 0.5 μm or less and preferably 0.1 μm or less. When the arithmetic mean roughness Ra of the outer circumferential surface of the leg portion 16 is 0.5 μm or less and particularly 0.1 μm or less, the desired strength can be ensured because of the following reason. No irregularities on which stress is likely to concentrate are present on the outer circumferential surface of the leg portion 16. Therefore, even when an impact is applied to the leg portion 16, stress concentration on the outer circumferential surface can be prevented. In the insulator 3, it is preferable that not only the outer circumferential surface of the leg portion 16 but also a portion of the inner circumferential surface of the insulator 3, which portion is in contact with the center electrode 4, has an arithmetic mean roughness Ra within the above range, and it is more preferable that the entire surface of the insulator 3 has an arithmetic mean roughness Ra within the above range.

The arithmetic mean roughness Ra can be measured using a surface roughness meter according to JIS B 0601.

When the arithmetic mean roughness Ra of the outer circumferential surface of the leg portion 16 is within the above range, the strength of the insulator 3 is improved, but discharge along the outer circumferential surface (hereinafter may be referred to as creeping discharge) is likely to occur to cause rearward sparking. One possible method for reducing the occurrence of rearward sparking is to chamfer or round (radius) the outer circumferential edge of the forward end (hereinafter referred to as the "forward outer circumferential edge") of the insulator 3. Although the occurrence of rearward sparking can be prevented with this method, the method increases the possibility of occurrence of lateral sparking. Also, in the case where the forward outer circumferential edge of the insulator 3 is not chamfered or rounded, the forward outer circumferential edge of the insulator 3 may be chipped in the course of production thereof. Specifically, in the course of production of such insulators 3, their forward outer circumferential edges may chipped when they come into collision with each other. It is therefore preferable that the forward outer circumferential edge of the insulator 3 is chamfered or rounded. The present inventors have found the following fact. Rearward sparking resistance deteriorates when the arithmetic mean roughness of the outer circumferential surface of the leg portion 16 is within the above range. However, even in this case, by providing a step with a specific size described later; i.e., a second section described later, on the outer circumferential surface of the leg portion 16, a discharge path (a discharge path for "creeping discharge") along the outer circumferential surface of the leg portion 16 is obstructed by the step, and the occurrence of rearward sparking can thereby be prevented.

Referring next to FIG. 2, the leg portion 16 having a step; i.e., a second section 42, will be described. For the sake of convenience, only the insulator 3 and the center electrode 4 are shown in FIG. 2. The leg portion 16 in the present embodiment has a tapered section whose outer diameter decreases from its base end toward its forward end. The forward outer circumferential edge of the leg portion 16 forms a gently curved surface with the rate of reduction in diameter increasing toward the forward end, and the forward end of the leg portion 16 is a flat surface orthogonal to the axial line O. The leg portion 16 of the insulator 3 in the present embodiment has a first section 41, the second section 42, and a third section 43 which are disposed in this order from the base end toward the forward end. The second section 42 has the same shape as that obtained by cutting the rounded forward outer circumferential edge of the insulator 3. The first section 41 is located forward of the step portion 8 and its outer diameter decreases from the base end of the first section 41 toward its forward end. A base end portion of the first section 41 is a tapered section, and the outer circumferential surface of a forward end portion of the first section 41 is a gently curved surface with the rate of reduction in diameter increasing toward the forward end. The second section 42 is located forward of and adjacent to the first section 41 and is tapered such that its outer diameter decreases from the base end of the second section 42 toward its forward end. As shown in FIG. 2, in a cross section $S_1$ obtained by cutting the leg portion 16 and including the axial line O, a line $T_{42}$ representing the outer circumferential surface of the second section 42 is located inward of a first straight line $L_{41}$ passing through base and forward ends of the outer circumferential surface of the first section 41, and the forward end angle θ between the first straight line $L_{41}$ and a second straight line $L_{42}$ passing through base and forward ends of the outer circumferential surface of the second section 42 is θ≥15° and preferably θ<90°. A base end portion of the third section 43 is tapered such that its outer diameter decreases forward, and the outer circumferential surface of a forward end portion of the third section 43 forms a gently curved surface with the rate of reduction in diameter increasing toward the forward end and is connected to the flat forward end surface of the insulator 3. The third section 43 is located forward of the second section 42, and the outer diameter of the third section 43 is equal to or less than the forward end outer diameter Ds of the second section 42 over the entire third section 43. In the cross section $S_1$, a line $T_{43}$ representing at least the outer circumferential surface of a rear end portion of the third section 43, which rear end portion is connected to the forward end of the second section 42, is located outward of the second straight line $L_{42}$. The base end of the first section 41 coincides with the boundary between the step portion 8 and the first section 41, and the rate of reduction in diameter changes greatly at the boundary. The rate of reduction in diameter changes greatly also at the forward end of the first section 41; i.e., the base end of the second section 42, and the forward end of the second section 42.

In the leg portion 16, the forward end outer diameter Ds of the second section 42 and the base end outer diameter Dk of the second section 42 satisfy the following formula (1).

$$5\ \mu m \leq (Dk-Ds)/2 \leq 200\ \mu m \quad (1)$$

Since the leg portion 16 has the second section 42; i.e., a step which satisfies the above formula (1), the occurrence of rearward sparking can be prevented even when the arithmetic mean roughness Ra of the outer circumferential surface of the leg portion 16 is smaller than the prescribed value. Preferably, the forward end outer diameter Ds and the base end outer diameter Dk of the second section 42 satisfy the following formula (2).

$$5\ \mu m \leq (Dk-Ds)/2 \leq 50\ \mu m \quad (2)$$

When the second section 42 of the leg portion 16 satisfies the above formula (2), it is possible to simultaneously achieve the prevention of occurrence of rearward sparking and the maintenance of the strength of the insulator 3 more certainly. If the value of the expression (Dk−Ds)/2 representing the relation between the forward end outer diameter Ds and the base end outer diameter Dk of the second section 42 is less than 5 μm, the occurrence of rearward sparking cannot be prevented. If the value of the expression (Dk−Ds)/2 representing the relation between the forward end outer diameter Ds and the base end outer diameter Dk of the second section 42 exceeds 200 μm, stress is more likely to concentrate on the second section 42, and the desired strength cannot be ensured. If the forward end angle θ is less than 15°, the effect of obstructing the discharge path along the outer circumferential surface of the leg portion 16 is small, so that the occurrence of rearward sparking cannot be prevented. If the outer circumferential surface of the second section 42 is inclined rearward with respect to a plane orthogonal to the axial line O, stress is likely to concentrate on the second section 42, and the desired strength cannot be ensured.

The insulator 3 in the present embodiment has one step; i.e., one second section 42. However, the insulator 3 may have, in the third section 43, at least one step similar to the second section 42. The second section 42 may be located in any part of the leg portion 16, but it is preferable that the base end of the second section 42 is located at least 3 mm forward of the forward end of a part of the step portion 8, which part is engaged with the metallic shell 6. When the second section 42 is located at the above location, the occurrence of rearward sparking is prevented more effectively, and the ignition performance can be more improved.

Figure 3:
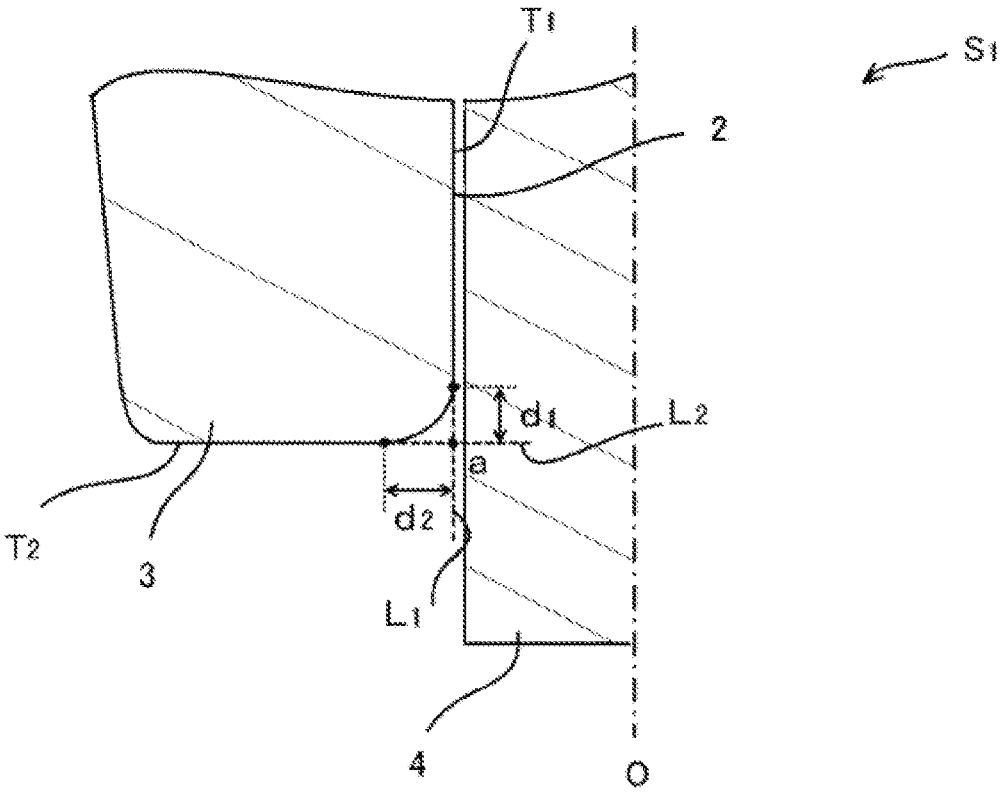
FIG. 3 is a partial cross sectional view showing a forward end portion of the cross section which is obtained by cutting the insulator of the spark plug shown in FIG. 1 and includes the axial line.

In the insulator 3, it is preferable that the arithmetic mean roughness Ra of a portion of the inner circumferential surface forming the axial hole 2, which portion faces the center electrode 4, is 0.5 μm or less. Preferably, the inner circumferential edge of the forward end (hereinafter referred to as the "forward inner circumferential edge") of the insulator 3 is neither chamfered nor rounded, and the forward end surface of the insulator 3 is disposed at a right angle to its inner circumferential surface. Specifically, the forward inner circumferential edge of the insulator 3 is preferably as follows. As shown in FIG. 3, in the cross section $S_1$ obtained by cutting the insulator 3 and including the axial line O, a virtual line $L_1$ is drawn by extending a line segment $T_1$ representing the wall surface of the axial hole 2 in the forward direction, and a virtual line $L_2$ is drawn by extending a line segment $T_2$ representing the forward end surface of the insulator 3 radially inward. Let the intersection of the virtual line $L_1$ and the virtual line $L_2$ be "a." Then the distance $d_1$ from the intersection a to the forward end of the line segment $T_1$ and also the distance $d_2$ from the intersection a to an end of the line segment $T_2$ which is toward the axial line O are 200 μm or less.

As described above, both the distances $d_1$ and $d_2$ at the forward inner circumferential edge of the insulator 3 are 200 μm or less, and the arithmetic mean roughness Ra of the portion of the inner circumferential surface of the insulator 3, which portion faces the center electrode 4, is 0.5 μm or less. In this case, while the occurrence of preignition is prevented, the strength of the forward end portion of the insulator 3 can be improved. When the forward inner circumferential edge of the insulator is not chamfered or not shaped into a curved surface and therefore the forward end of the inner circumferential surface of the insulator is located close to the center electrode, the forward end of the insulator 3 easily receives heat from the center electrode 4, and preignition caused by overheating of the forward end of the insulator tends to occur. Therefore, in a conventional insulator, its forward inner circumferential edge is chamfered or shaped into a curved surface. However, in the insulator 3 in the present embodiment, the arithmetic mean roughness Ra of the inner circumferential surface of the insulator 3 is 0.5 μm or less, which is smaller than that of the conventional insulator. In this case, the specific surface area of the inner circumferential surface of the insulator 3 is small. Therefore, although the forward end of the inner circumferential surface of the insulator 3 is located close to the center electrode 4, the forward end of the insulator 3 is less likely to receive heat from the center electrode 4. In the insulator 3 in the present embodiment, both the distances $d_1$ and $d_2$ at the forward inner circumferential edge of the insulator 3 are 200 μm or less. This allows the forward end portion of the insulator 3 to have a wall thickness enough to improve the strength of the forward end portion of the insulator 3. Even in this case, since the arithmetic mean roughness Ra of the portion of the inner circumferential surface of the insulator 3, which portion is in contact with the center electrode 4, is 0.5 μm or less, the occurrence of preignition can be prevented.

Second Embodiment

Figure 4:
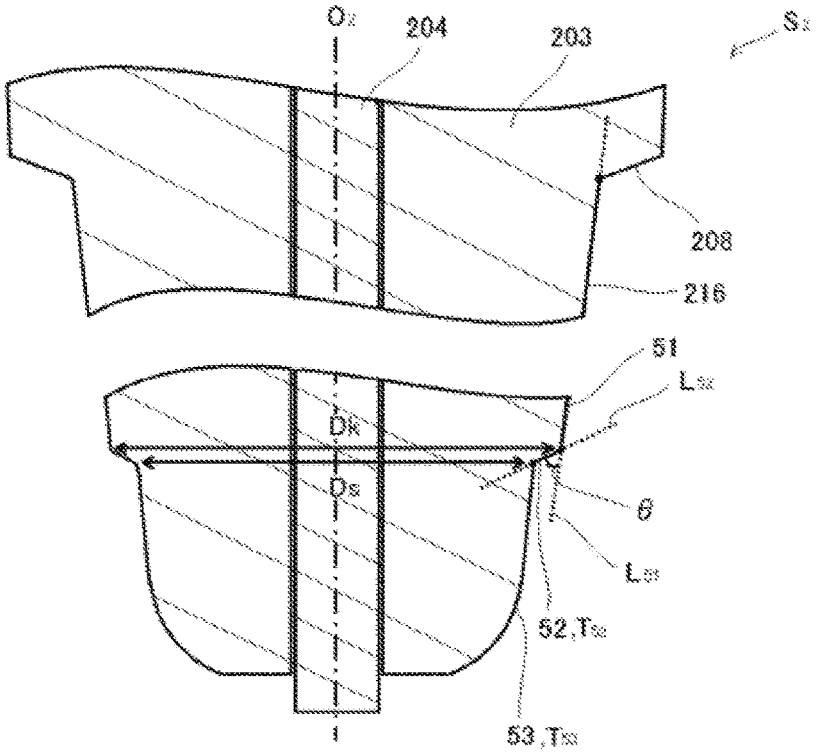
FIG. 4 is a partial cross sectional view showing another embodiment of the insulator in the present invention.

An insulator 203 in the present embodiment has the same structure as the insulator 3 in the first embodiment except that a step; i.e., a second section 52, is located at an intermediate position of a tapered section of a leg portion 216. As shown in FIG. 4, the leg portion 216 in the present embodiment has a first section 51, the second section 52, and a third section 53 which are disposed in this order from the base end of the leg portion 216 toward its forward end. The second section 52 is provided by partially cutting away the tapered section. The first section 51 is located forward of and adjacent to a step portion 208 and is tapered such that its outer diameter decreases from the base end of the first section 51 toward its forward end. The second section 52 is located forward of and adjacent to the first section 51 and is tapered such that its outer diameter decreases from the base end of the second section 52 toward its forward end. The third section 53 is located forward of and adjacent to the second section 52 and is tapered such that its outer diameter decreases from the base end of the third section 53 toward its forward end. The outer circumferential surface of a forward end portion of the third section 53 is formed into a gently curved surface with the rate of reduction in diameter increasing toward the forward end and is connected to the flat forward end surface of the insulator 203.

Third Embodiment

Figure 5:
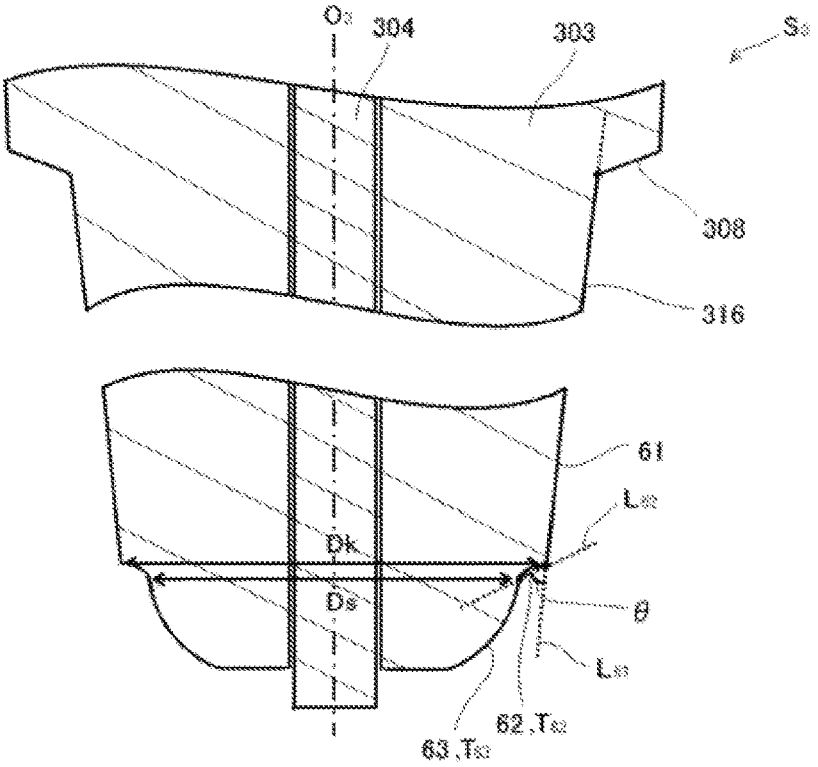
FIG. 5 is a partial cross sectional view showing yet another embodiment of the insulator in the present invention.

An insulator 303 in the present embodiment has the same structure as the insulator 3 in the first embodiment except that a step; i.e., a second section 62, is located at the boundary between a tapered section of a leg portion 316 and a curved surface formed at the forward outer circumferential edge of the leg portion 316 and that the second section 62 has a concave shape. As shown in FIG. 5, the leg portion 316 in the present embodiment has a first section 61, the second section 62, and a third section 63 which are disposed in this order from the base end of the leg portion 316 toward its forward end. The first section 61 is located forward of and adjacent to a step portion 308 and is tapered such that its outer diameter decreases from the base end of the first section 61 toward its forward end. The second section 62 is located forward of and adjacent to the first section 61, and its diameter decreases toward the forward end of the second section 62 to form a concave surface. In a cross section $S_3$ shown in FIG. 5, a line $T_{62}$ representing the second section 62 is a curve concave toward an axial line $O_3$. The third section 63 is located forward of and adjacent to the second section 62, and the outer circumferential surface of the third section 63 forms a gently curved surface with the rate of reduction in diameter increasing toward the forward end of the third section 63 and is connected to the flat forward end surface of the insulator 303.

Fourth Embodiment

Figure 6:
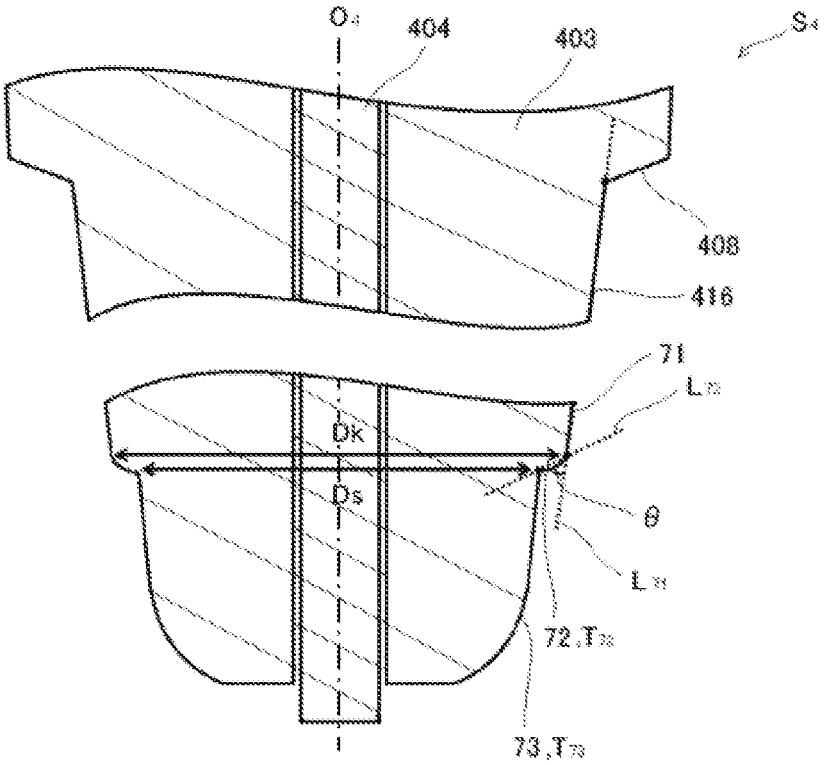
FIG. 6 is a partial cross sectional view showing still another embodiment of the insulator in the present invention.

An insulator 403 in the present embodiment has the same structure as the insulator 203 in the second embodiment except that a step; i.e., a second section 72, has a convex shape. As shown in FIG. 6, a leg portion 416 in the present embodiment has a first section 71, the second section 72, and a third section 73 which are disposed in this order from the base end of the leg portion 416 toward its forward end. The first section 71 is located forward of and adjacent to a step portion 408 and is tapered such that its outer diameter decreases from the base end of the first section 71 toward its forward end. The second section 72 is located forward of and adjacent to the first section 71 and its outer diameter decreases toward the forward end of the second section 72 to form a convex surface. In a cross section $S_4$ shown in FIG. 6, a line $T_{72}$ representing the second section 72 is a curve convex outward. The third section 73 is located forward of and adjacent to the second section 72 and is tapered such that its outer diameter decreases from the base end of the third section 73 toward its forward end. The outer circumferential surface of a forward end portion of the third section 73 forms a gently curved surface with the rate of reduction in diameter increasing toward the forward end and is connected to the flat forward end surface of the insulator 403.

For example, when an impact is applied to the forward end portion of the spark plug 1 because of vibration etc. caused by pressure changes in a combustion chamber during operation of an internal combustion engine or when an impact is applied to the forward end portion of the spark plug 1 during, for example, mounting of the spark plug 1 to the internal combustion engine, stress tends to concentrate on a portion of the insulator 3 (203, 303, 403) which is exposed to combustion gas; i.e., on the outer circumferential surface of the leg portion 16 (216, 316, 416). As the wall thickness of the insulator 3 (203, 303, 403) decreases, the stress is more likely to concentrate on the outer circumferential surface, causing breakage of the insulator 3 (203, 303, 403). In the insulator 3 (203, 303, 403) in the spark plug 1 in each of the above embodiments, the arithmetic mean roughness Ra of the outer circumferential surface of the leg portion 16 (216, 316, 416) is 0.5 μm or less. In this case, stress concentration on the outer circumferential surface can be reduced, and the desired strength can be ensured. The outer circumferential surface has the first section 41 (51, 61, 71), the second section 42 (52, 62, 72), and the third section 43 (53, 63, 73), and the forward end outer diameter Ds and the base end outer diameter Dk of the second section 42 (52, 62, 72) satisfy $5\ \mu m \leq (Dk-Ds)/2 \leq 200\ \mu m$. Therefore, although the arithmetic mean roughness Ra of the outer circumferential surface is 0.5 μm or less, the occurrence of rearward sparking can be prevented.

The spark plug 1 in the first embodiment of the spark plug according to the present invention can be manufactured, for example, in the following manner.

The insulator 3 can be produced by firing a compact molded from a raw material powder. Specifically, alumina serving as a main component and a compound of an element such as Si, Mg, Ca, or Ba that serves as a sintering agent are mixed to prepare the raw material powder. Sodium polycarboxylate (a dispersant) and a solvent such as water or an alcohol are added to the raw material powder and mixed to prepare a slurry for molding. Next, the slurry for molding is spray-dried, and the product is mixed with a resin under pressure and heat to prepare a granulated product for molding. The obtained granulated product for molding is subjected to injection molding to obtain the compact.

In the injection molding, a die that can form the insulator 3 having the above-described shape is used. A pattern for forming the first section 41, the second section 42, and the third section 43 is provided in advance on the inner circumferential surface of the die. With the injection molding, by simply providing the desired pattern on the inner circumferential surface of the die, the first section 41, the second section 42, and the third section 43 can be easily formed, and the arithmetic mean roughness Ra of surfaces such as the outer circumferential surface of the insulator 3 can be easily adjusted to 0.5 μm or less and further to 0.1 μm or less.

Next, the compact formed into the desired shape is calcined in an air atmosphere for debindering. Next, the debindered compact is fired at 1,350° C. to 1,600° C. for 1 to 24 hours. If necessary, a glaze is applied to the fired compact, and the resulting compact is subjected to finish firing to thereby obtain the insulator 3.

The spark plug 1 including the insulator 3 is manufactured, for example, as follows. Specifically, the center electrode 4 formed into a prescribed shape is inserted into the axial hole 2 of the obtained insulator 3. A composition forming the connecting portion 12 is then charged into the axial hole 2 and is compressed preliminary. Next, while the metallic terminal 5 is press-fitted into the axial hole 2 from an end of the axial hole 2, the composition is compressed and heated. The composition is thereby sintered, and the connecting portion 12 is formed. Next, the insulator 3 with the center electrode 4 and the metallic terminal 5 inserted thereinto is inserted into the metallic shell 6 formed into a prescribed shape to engage the step portion 8 with the seat portion 9, whereby the insulator 3 is attached to the metallic shell 6. Before or after the insulator 3 is attached to the metallic shell 6, the ground electrode 7 is joined to the metallic shell 6 at a portion near its forward end portion by, for example, electric resistance welding. Finally, a distal end portion of the ground electrode 7 is bent toward the center electrode 4 so that the distal end portion of the ground electrode 7 faces the forward end of the center electrode 4, whereby the spark plug 1 is manufactured.

The spark plug according to the present invention is used as an ignition plug for an automobile internal combustion engine such as a gasoline engine. The threaded portion of the spark plug is screwed into a threaded hole formed in a head (not shown) that forms sectioned combustion chambers of an internal combustion engine and is thereby fixed at a prescribed position. The spark plug according to the present invention can be used for any internal combustion engine. The insulator in the spark plug according to the present invention has the desired strength and unlikely to cause rearward sparking. Therefore, the spark plug can be preferably used for an internal combustion engine in which the compression ratio in the combustion chamber is high and vibration is likely to be generated.

The spark plug according to the present invention is not limited to the embodiments described above, and various modifications can be made so long as the object of the present invention can be achieved.

For example, the shape, number, arrangement, etc. of steps; i.e., second sections, formed in the leg portion of the insulator in the present invention are not limited to those in the embodiments described above and may be appropriately set according to, for example, the required performance of the spark plug.

EXAMPLES

Test Example 1

(Manufacturing of Spark Plug)

Spark plugs having the structure shown in FIG. 1 were manufactured in the manner described above. However, as shown in Table 1, the arithmetic mean roughness Ra of the outer circumferential surface of the leg portion of the insulator varies among the spark plugs, and the relation (Dk−Ds)/2 between the forward end outer diameter Ds and the base end outer diameter Dk of the step (second section) on the outer circumferential surface varies among the spark plugs. Moreover, the distance H from the forward end of a part of the step portion, which part is engaged with the metallic shell, to the base end of the step (second section) varies among the spark plugs. In each spark plug whose insulator has a step among the spark plugs shown in Table 1, the step was located at an intermediate portion of the tapered section as shown in FIG. 4, and the forward end angle θ between the first straight line passing through the base and forward ends of the outer circumferential surface of the first section and the second straight line passing through the base and forward ends of the outer circumferential surface of the second section was within the range of 15° θ<90°. The arithmetic mean roughness of the outer circumferential surface of the leg portion was measured using a non-contact 3D measuring instrument NH-3 (manufactured by Mitaka Kohki Co., Ltd.) according to JIS B 0601.

The dimensions of each of the spark plugs shown in Table 1 are as follows.

Nominal diameter of the threaded portion of the metallic shell: M12

Distance from the forward end of the insulator to the forward end of the part of the step portion, which part is engaged with the metallic shell: 18 mm Outer diameter of the insulator measured at the forward end of the insulator: 4.0 mm Thickness of the insulator measured at the forward end of the insulator: 0.5 mm Outer diameter of the leg portion of the insulator measured at the base end of the leg portion: 9.5 mm Thickness of the leg portion of the insulator measured at the base end of the leg portion: 3.4 mm (Ignition Performance Test)

For each of the samples shown in Table 1, spark plugs with spark discharge gaps G of 1.00 mm, 1.05 mm, and 1.10 mm were prepared. Each spark plug was disposed in a chamber. Then a high voltage was applied to the center electrode, and an image of discharge was taken by a camera. The distance between the metallic shell and the insulator in a region near the forward end of the metallic shell had been adjusted such that no lateral sparking occurred. Therefore, in this ignition performance test, rearward sparking was observed. For each spark plug, the high voltage was applied 100 times. Each time the voltage was applied, an image was taken and checked, and the number of times leakage occurred was counted. When the number of times leakage occurred was 30 or less, the spark plug was rated "good." When the number of times leakage occurred was more than 30, the spark plug was rated "poor." The ignition performance was rated on the following point scale. The results are shown in Table 1.

1: "Poor" when the spark discharge gap G was 1.00 mm.

2: "Good" when the spark discharge gap G was 1.00 mm or "poor" when the spark discharge gap G was 1.05 mm.

3: "Good" when the spark discharge gap G was 1.05 mm or "poor" when the spark discharge gap G was 1.10 mm.

4: "Good" when the spark discharge gap G was 1.10 mm.

(Test of Strength of Insulator)

A bending test was performed on each of the samples shown in Table 1. Specifically, an autograph was used to apply a load to the forward end portion of the insulator at three different circumferential positions such that the load was applied in a direction orthogonal to the axial line, and the load when the insulator was fractured (fracture load) was measured. The measurement was performed 5 times for each sample. Sample No. 5 was used as a representative example of a conventional spark plug, and the score of the bending test on the conventional spark plug was set to 1. The strength of the insulator of each spark plug was evaluated using the following scoring system based on the difference in average fracture load between the spark plug and the conventional spark plug. The results are shown in Table 1.

1: Difference in average fracture load was less than 0.1 kN.

5: Difference in average fracture load was 0.1 kN or more and less than 0.2 kN.

10: Difference in average fracture load was 0.2 kN or more.

TABLE 1

| Sample No. | | Arithmetic mean roughness Ra (μm) | (Dk − Ds)/2 (μm) | Distance H (mm) | Forward end angle θ between first and second straight lines (degree) | Evaluation results: Ignition performance | Evaluation results: Strength of insulator |
|---|---|---|---|---|---|---|---|
| 1 | Example | 0.03 | 30 | 5 | 45 | 4 | 10 |
| 2 | Example | 0.04 | 30 | 5 | 45 | 4 | 10 |
| 3 | Example | 0.1 | 30 | 5 | 45 | 4 | 10 |
| 4 | Example | 0.5 | 30 | 5 | 45 | 4 | 5 |
| 5 | Comparative Example | 1 | 30 | 5 | 45 | 4 | 1 |
| 6 | Comparative Example | 0.5 | None | — | — | 2 | 10 |
| 7 | Comparative Example | 0.1 | None | — | — | 1 | 10 |
| 8 | Example | 0.1 | 5 | 5 | 45 | 4 | 10 |
| 9 | Example | 0.1 | 30 | 5 | 45 | 4 | 10 |
| 10 | Example | 0.1 | 50 | 5 | 45 | 4 | 10 |
| 11 | Example | 0.1 | 200 | 5 | 45 | 4 | 5 |
| 12 | Comparative Example | 0.1 | 300 | 5 | 45 | 4 | 1 |
| 13 | Example | 0.5 | 30 | 4 | 45 | 4 | 10 |
| 14 | Example | 0.5 | 30 | 3 | 45 | 4 | 10 |
| 15 | Example | 0.5 | 30 | 2 | 45 | 3 | 10 |

As shown in Table 1, in samples 1 to 4, 8 to 11, and 13 to 15 which are within the scope of the present invention, the results of evaluation of the ignition performance and the strength of the insulator were good. However, in samples 5 to 7 and 12 which are outside the scope of the present invention, the results of evaluation of at least one of the ignition performances and the strength of the insulator were poor. Specifically, in samples 6 and 7 in which no step was formed and the arithmetic mean roughness Ra of the outer circumferential surface of the leg portion of the insulator was 0.5 μm or less, the ignition performance was poor. In sample 5 in which the arithmetic mean roughness Ra of the outer circumferential surface of the leg portion of the insulator was 1 μm, the results of evaluation of the strength of the insulator were poor. In sample 12 in which the value of the expression (Dk−Ds)/2 representing the relation between the forward end outer diameter Ds and base end outer diameter Dk of the step was 300 μm, the step portion was fractured, and the results of evaluation of the strength of the insulator were poor.

Test Example 2

Spark plugs were produced in the same manner as in Test Example 1 except that the arithmetic mean roughness Ra of the portion of the inner circumferential surface of the insulator, which portion was in contact with the center electrode, was changed as shown in Table 2 and that the distances $d_1$ and $d_2$ around the forward inner circumferential edge of the insulator shown in FIG. 3 were changed as shown in Table 2. The dimensions of each spark plug were the same as those in Test Example 1 except for dimensions shown in Table 2.

For each of the samples, the ignition performance test and the test of the strength of the insulator were performed in the same manner as in Test Example 1. The results are shown in Table 2.

TABLE 2

| Sample No. | | Arithmetic mean roughness Ra of outer circumferential surface (μm) | (Dk − Ds)/2 (μm) | Arithmetic mean roughness Ra of inner circumferential surface (μm) | Forward end angle θ between first and second straight lines (degree) | Larger one of distances d1 and d2 (μm) | Evaluation results | |
|---|---|---|---|---|---|---|---|---|
| | | | | | | | Ignition performance | Strength of insulator |
| 16 | Comparative Example | 0.1 | 30 | 0.1 | 45 | 300 | 4 | 5 |
| 17 | Example | 0.1 | 30 | 0.1 | 45 | 200 | 4 | 10 |
| 18 | Example | 0.1 | 30 | 0.1 | 45 | 100 | 4 | 10 |
| 19 | Example | 0.1 | 30 | 0.1 | 45 | 50 | 4 | 10 |
| 20 | Example | 0.1 | 30 | 0.1 | 45 | 10 | 4 | 10 |

As shown in Table 2, in samples 17 to 20, the arithmetic mean roughness Ra of the portion of the inner circumferential surface of the insulator which portion was in contact with the center electrode was 0.5 μm or less, and the distances $d_1$ and $d_2$ were 200 μm or less. In samples 17 to 20, the results of evaluation of the strength of the insulator were better than those of sample 16 in which the larger of the distances $d_1$ and $d_2$ was 300 μm. These results show that an insulator in which both the distances $d_1$ and $d_2$ are 200 μm or less has preferable strength.

Test Example 3

Spark plugs were produced in the same manner as in Test Example 1 except that the forward end angle θ between the first straight line and the second straight line was set to a value shown in Table 3. The dimensions of each spark plug were the same as those in Test Example 1 except for that shown in Table 3.

For each of the samples, the ignition performance test and the test of the strength of the insulator were performed in the same manner as in Test Example 1. The results are shown in Table 3.

TABLE 3

| Sample No. | | Arithmetic mean roughness Ra (μm) | (Dk − Ds)/2 (μm) | Distance H (mm) | Forward end angle θ between first and second straight lines (degree) | Evaluation results | |
|---|---|---|---|---|---|---|---|
| | | | | | | Ignition performance | Strength of insulator |
| 21 | Example | 0.03 | 30 | 5 | 30 | 4 | 10 |
| 22 | Example | 0.03 | 30 | 5 | 15 | 3 | 10 |
| 23 | Comparative Example | 0.03 | 30 | 5 | 10 | 1 | 10 |

As shown in Table 3, in each spark plug in which the forward end angle θ between the first straight line and the second straight line was 15° or more, the ignition performance was better than that of a spark plug with a forward end angle θ of less than 15°.

DESCRIPTION OF REFERENCE NUMERALS

1: spark plug
2: axial hole
3: 203, 303, 403: insulator
4: 204, 304, 404: center electrode
4*a*: projecting portion
5: metallic terminal
6: metallic shell
7: ground electrode
8: step portion
8*a*: inner step portion
9: seat portion
12: connecting portion
13: flange portion
14: rear trunk portion
15: forward trunk portion
16: leg portion
17: threaded portion
18: gas seal portion
20: tool engagement portion
21: crimp portion
22, 23: ring member
24: talc
27: outer layer
28: core portion
41, 51, 61, 71: first section
42, 52, 62, 72: second section, step
43, 53, 63, 73: third section
G: gap
Dk: base end outer diameter of the second section
Ds: forward end outer diameter of the second section Having described the invention, the following is claimed:

1. A spark plug comprising:

a tubular insulator having an axial hole extending in the direction of an axial line, the insulator including a step portion which is disposed on an outer circumference of the insulator and whose outer diameter decreases toward a forward end of the insulator;

a center electrode disposed at a forward end of the axial hole; and a tubular metallic shell disposed around the insulator, the step portion being engaged with an inner circumference of the metallic shell, wherein the insulator includes a leg portion located forward of and adjacent to the step portion, and an outer circumferential surface of the leg portion has an arithmetic mean roughness Ra of 0.5 μm or less, wherein the leg portion includes a first section which is located forward of and adjacent to the step portion and whose outer diameter decreases from a base end of the first section toward a forward end thereof, a second section which is located forward of and adjacent to the first section and whose outer diameter decreases from a base end of the second section toward a forward end thereof, wherein, in a cross section obtained by cutting the leg portion and including the axial line, a line representing an outer circumferential surface of the second section includes a ling segment located inward of a first straight line passing through base and forward ends of an outer circumferential surface of the first section, and a forward end angle θ between the first straight line and a second straight line passing through base and forward ends of an outer circumferential surface of the second section is θ≥15°, and a third section which is located forward of and adjacent to the second section and whose outer diameter is equal to or less than a forward end outer diameter Ds of the second section over the entire third section, wherein, in the cross section, a line representing at least an outer circumferential surface of a rear end portion of the third section, which rear end portion is connected to the forward end of the second section, is located outward of the second straight line, wherein an expression (Dk−Ds)/2 which represents the relation between the forward end outer diameter Ds and a base end outer diameter Dk of the second section satisfies 5 μm≤(Dk−Ds)/2≤200 μm, and wherein both the second section and the third section are not in contact with another member.

2. A spark plug according to claim 1, wherein the center electrode includes, at a rear end thereof, a projecting portion protruding radially outward, wherein the axial hole of the insulator has an inner step portion engaged with the projecting portion of the center electrode, wherein a portion of an inner circumferential surface of the axial hole, which portion faces the center electrode, has an arithmetic mean roughness Ra of 0.5 μm or less, and wherein, in a cross section obtained by cutting the insulator and including the axial line, when a line segment representing a portion of the axial hole, which portion is located forward of and adjacent to the inner step portion and extends linearly from a base end of that portion to a forward end thereof is defined as a line segment $T_1$, and a line segment representing a forward end surface of the insulator is defined as a line segment $T_2$, and an intersection between a virtual line $L_1$ obtained by extending the line segment $T_1$ forward and a virtual line $L_2$ obtained by extending the line segment $T_2$ radially inward is defined as an intersection a, a distance $d_1$ from the forward end of the line segment $T_1$ to the intersection a and a distance $d_2$ from an axial line-side end of the line segment $T_2$ to the intersection a are 200 μm or less.

3. A spark plug according to claim 1, wherein the arithmetic mean roughness Ra of the outer circumferential surface of the leg portion is 0.1 μm or less.

4. A spark plug according to claim 1, wherein the base end of the second section is located at least 3 mm forward of a forward end of a part of the step portion, which part is engaged with the metallic shell.

5. A spark plug according to claim 1, wherein an expression (Dk−Ds)/2 which represents the relation between the forward end outer diameter Ds and the base end outer diameter Dk of the second section satisfies 5 μm≤(Dk−Ds)/2≤50 μm.

6. A spark plug according to claim 2, wherein the arithmetic mean roughness Ra of the outer circumferential surface of the leg portion is 0.1 μm or less.

7. A spark plug according to claim 2, wherein the base end of the second section is located at least 3 mm forward of a forward end of a part of the step portion, which part is engaged with the metallic shell.

8. A spark plug according to claim 3, wherein the base end of the second section is located at least 3 mm forward of a forward end of a part of the step portion, which part is engaged with the metallic shell.

9. A spark plug according to claim 2, wherein an expression (Dk−Ds)/2 which represents the relation between the forward end outer diameter Ds and the base end outer diameter Dk of the second section satisfies 5 μm≤(Dk−Ds)/2≤50 μm.

10. A spark plug according to claim 3, wherein an expression (Dk−Ds)/2 which represents the relation between the forward end outer diameter Ds and the base end outer diameter Dk of the second section satisfies 5 μm≤(Dk−Ds)/2≤50 μm.

11. A spark plug according to claim 4, wherein an expression (Dk−Ds)/2 which represents the relation between the forward end outer diameter Ds and the base end outer diameter Dk of the second section satisfies 5 μm≤(Dk−Ds)/2≤50 μm.

* * * * *